US008275157B2

(12) United States Patent
Akino

(10) Patent No.: US 8,275,157 B2
(45) Date of Patent: Sep. 25, 2012

(54) RIBBON MICROPHONE AND RIBBON MICROPHONE UNIT

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 821 days.

(21) Appl. No.: 12/276,923

(22) Filed: Nov. 24, 2008

(65) Prior Publication Data

US 2009/0141914 A1 Jun. 4, 2009

(30) Foreign Application Priority Data

Nov. 29, 2007 (JP) ..... 2007-308289

(51) Int. Cl.
*H04R 25/00* (2006.01)

(52) U.S. Cl. ..... 381/176

(58) Field of Classification Search ..... 381/176, 381/399, 398, 423

See application file for complete search history.

(56) References Cited

U.S. PATENT DOCUMENTS

| | | | | |
|---|---|---|---|---|
| 2,226,934 | A * | 12/1940 | Kannenberg | 381/176 |
| 2,233,886 | A * | 3/1941 | Cowley et al. | 381/176 |
| 2,963,557 | A * | 12/1960 | Anderson | 381/176 |
| 7,894,619 | B2 * | 2/2011 | Crowley | 381/176 |

FOREIGN PATENT DOCUMENTS

| | | | |
|---|---|---|---|
| JP | 51-005437 | B | 6/1949 |
| JP | 56-117500 | A | 9/1981 |
| JP | 2006-319595 | A | 11/2006 |
| JP | 2007-049324 | A | 2/2007 |
| WO | WO 2006/047048 | A2 | 5/2006 |

OTHER PUBLICATIONS

Office Action issued on Mar. 6, 2012 in Japanese Patent Application No. 2007-308289.

* cited by examiner

*Primary Examiner* — Lex Malsawma
(74) *Attorney, Agent, or Firm* — Sughrue Mion, PLLC

(57) ABSTRACT

A ribbon microphone unit includes: an electrode lead portion for conducting an electric signal which a ribbon diaphragm generates cooperating with a magnet; a tightening member for securing the ribbon diaphragm; and a screw for crimping the tightening member, wherein the tightening member is crimped via the ribbon diaphragm and the electrode lead portion by the screw, and wherein the ribbon diaphragm includes a portion sandwiched by the tightening member, and the portion is formed in an irregular shape in the thickness direction.

15 Claims, 9 Drawing Sheets

Fig. 1A
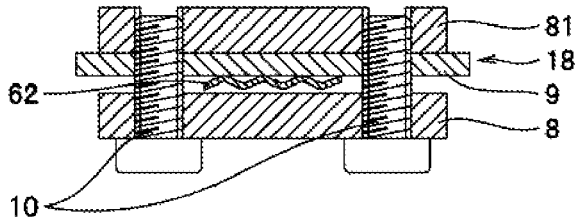
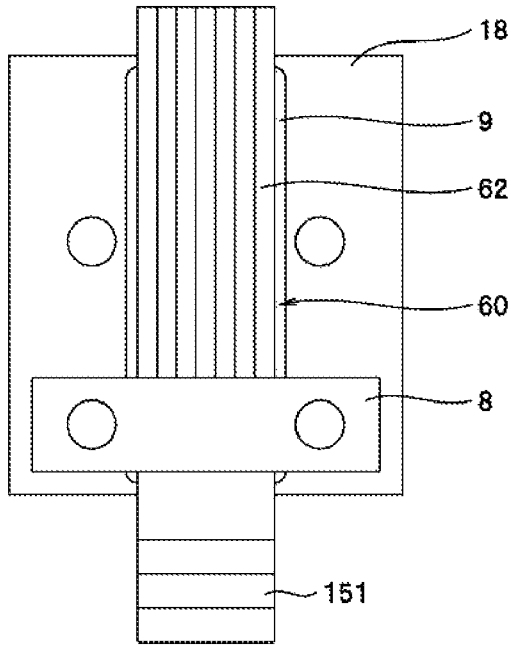
Fig. 1B
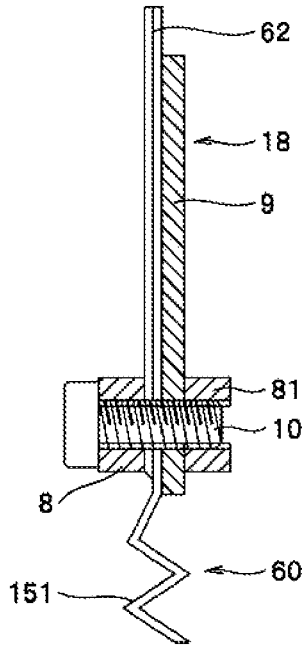
Fig. 1C

RIBBON MICROPHONE AND RIBBON MICROPHONE UNIT

BACKGROUND OF THE INVENTION

1. Field of the Invention

The present invention relates to ribbon microphones and ribbon microphone units.

2. Related Background of the Invention

A ribbon microphone includes a magnet for forming a magnetic field and a ribbon diaphragm, as the main component members. The magnet is disposed on both sides of the ribbon diaphragm to sandwich the same, whereby a magnetic field is formed between the magnets on the both sides. The ribbon diaphragm is given an appropriate tension and disposed within the magnetic field while the both longitudinal ends are held down. In response to a sound wave, the ribbon diaphragm vibrates within the magnetic field and thereby a current corresponding to the sound wave flows through the ribbon diaphragm and thus the sound wave is converted into an electric signal. Typically, an aluminum foil is used as the material of the ribbon diaphragm. Since aluminium has a small conductive resistance as compared with other metallic materials and also has a low specific gravity, aluminium is suitable as the ribbon diaphragm of the ribbon microphone.

An electric signal which the ribbon diaphragm generates cooperating with the field is weak. Accordingly, the ribbon microphone commonly known includes a transformer to boost the voltage of a weak electric signal. However, since the electric signal flows, as a weak electric signal as is, on an electric circuit from the ribbon diaphragm to the transformer, the conductive resistance needs to be reduced as much as possible. If the conductive resistance is large, the sensibility of the electric signal will decrease and the expected acoustic characteristics cannot be obtained.

FIG. 5 shows an example of a typical ribbon microphone. FIG. 6 shows an example of a ribbon microphone unit built in this ribbon microphone. In FIG. 5, in a ribbon microphone 1, a housing of the microphone comprises a cylindrical base 6 and a microphone case 2 connected to the top end of the base 6. Inside this housing, a ribbon microphone unit 3 is assembled to a suitable support member that is secured to the base 6. The microphone unit 3 is covered with the microphone case 2. The bottom end of the base 6 is a connector portion 16, to which a microphone cable for delivering the output signal of the microphone to an external circuit is connected.

As also shown in FIG. 6, the ribbon microphone unit 3 includes a frame 7 formed in a rectangular frame shape that is long in the longitudinal direction. On both sides of the inner surface of the frame 7, a pair of permanent magnets 4, 4 are fixed along the longitudinal direction, with a predetermined spacing between the both permanent magnets 4, 4. The permanent magnets 4, 4 are magnetized in the width direction (horizontal direction in FIG. 6), and the directions of the magnetization of the pair of permanent magnets 4, 4 are the same. Accordingly, the parallel field is formed between the permanent magnets 4, 4.

Within the parallel field, a ribbon diaphragm (hereinafter, may be referred to simply as a "ribbon") 5 combining a diaphragm with a conductor is disposed. As shown in FIG. 10, the ribbon 5 forms a long and slender band shape, and both longitudinal ends thereof are secured to electrode lead portions 18, 18 provided on both longitudinal ends of the frame 7. The electrode lead portions 18, 18 are insulated from the frame 7, and are conducted to the ribbon 5 by sandwiching both ends of the ribbon 5 using tightening members comprising pressure plates 8, 8 and support plates 81, 81. Moreover, the electrode lead portions 18, 18 hold the ribbon 5 in a state where the ribbon 5 is given an appropriate tension. In the ribbon 5, portions 51, 51 other than the portions corresponding to the electrode lead portions 18, 18 are formed in the shape of a triangular wave by being alternately folded at fixed intervals. The direction of lines formed by the folding, i.e., the direction of the lines which the top and the bottom of the triangular wave draw are the width direction of the ribbon 5, and these lines are formed at fixed intervals. Hereinafter, both corrugated ends of the ribbon 5 are referred to as a corrugated end 51, 51, respectively. Terminal strips 9, 9 are overlapped onto the electrode lead portions 18, 18, respectively, and onto each terminal strip 9 the pressure plate 8 is overlapped sandwiching the end of the ribbon 5. These terminal strips 9, 9 are electrically conducted to each end of the ribbon 5 via the pressure plates 8, 8 so that a signal from the ribbon microphone unit 3 may be output from each of the terminal strips 9, 9. The intermediate portion in the longitudinal direction of the ribbon 5 is a corrugated intermediate portion 52, in which the top and the bottom of a triangular wave are formed along the line (i.e., line in the longitudinal direction of the ribbon 5) in the direction perpendicular to the direction of lines which the top and the bottom of the triangular wave of the corrugated ends 51, 51 draw. The both longitudinal ends 54, 54 of the ribbon 5 are flat, not having corrugated irregularities formed therein.

The ribbon 5 vibrates in response to a sound wave and in accordance with the sound wave. This vibration direction is the direction intersecting the magnetic flux between the permanent magnets 4, 4, and the ribbon 5 made of a conductor intersects the magnetic flux to thereby generate electric power, whereby an electric signal is generated between the both longitudinal ends of the ribbon 5, accordingly between the electrode lead portions 18, 18. Since this electric signal turns into a signal having a frequency and amplitude corresponding to the frequency and amplitude of the ribbon 5, a sound wave which hits the ribbon 5 will be converted into an electric signal corresponding to the sound wave. Since the ribbon microphone is an inertia control system, the resonance frequency of the ribbon 5 needs to be no greater than the low frequency of sound waves to be collected, in other words, needs to be a frequency lower than the lowest frequency of a frequency band in which sounds can be collected. For this reason, the tension of the ribbon 5 is set extremely low. As described above, in the ribbon 5, the corrugated ends 51, 51 are formed by the both ends being folded, whereby a low tension is realized.

In the example of the ribbon microphone described above, the intermediate portion in the longitudinal direction of the ribbon 5 is the corrugated intermediate portion 52, in which the top and the bottom of a triangular wave are formed along the longitudinal line of the ribbon 5. The ribbon of most of the conventional ribbon microphones is formed so that the direction of the lines, which the top and the bottom of the triangular wave draw, is the width direction of the ribbon, and the triangular wave travels across the longitudinal direction. FIG. 7, FIG. 8, and FIG. 9 show enlarged views of the electrode lead portion 18 having the ribbon diaphragm 5 and the pressure plate 8 in the ribbon microphone unit shown in FIG. 6. In FIGS. 7A and 7B, the both longitudinal ends of the ribbon diaphragm 5 are sandwiched by the support plates 81, 81 and the pressure plates 8,8, and are secured by fastening the both ends of the pressure plate 8 to the support plate 81 with screws 10, 10 respectively. As shown in FIG. 8, when the screw 10, 10 are tightly fastened, the pressure plate 8 is bend-deformed so as to surround the ribbon diaphragm 5 in the width direction, in other words, the pressure plate 8 is bend-deformed in such direction that the both ends rather than the center portion in the width direction of the diaphragm 5 come closer to the diaphragm 5. Because the pressure plate 8 is bend-deformed in this manner, the pressure in the center portion in the width direction of the ribbon diaphragm 5 is weak and only the both ends contact the pressure plate 8. Accordingly, the conductive resistance of the ribbon diaphragm 5 will increase. Then, as shown in FIG. 9, the pressure plate 8 is bent in a direction opposite to the above-described bending direction in advance, so that the ribbon diaphragm 5 may uniformly contact the pressure plate 8 when the both ends of the opposing pressure plate 8 are fastened. However, in order to deform the pressure plate 8 so that the both ends of the ribbon diaphragm 5 become flat and uniformly contact the pressure plate 8, expert skills and experiences of the operator are required. Moreover, even if the pressure plate 8 is deformed as described above, problems as described below cannot be resolved.

As shown in FIG. 10, the both longitudinal ends 54, 54 of the ribbon diaphragm 5 are flat planes. In the maintenance of the ribbon microphone, when replacing the ribbon diaphragm 5, as shown in FIG. 6, the both ends of the ribbon diaphragm 5 should be disposed in the electrode lead portions 18, 18 that are formed in the frame 7 of the ribbon microphone unit 3. However, since the both ends 54, 54 of the ribbon diaphragm 5 are flat planes, they are elastically weak and wobble and thus the position in attaching the both ends 54, 54 to the electrode lead portion 18 becomes unstable, and the attachment work of the diaphragm becomes difficult. Moreover, if the both ends of the ribbon diaphragm 5 are disposed in the electrode lead portions 18, 18 and then fastened with the screws 10, 10 via the pressure plate 8, a stress caused by fastening the screws 10, 10 transmits to the pressure plate 8 and twists the ribbon diaphragm 5. This stress on the diaphragm does not allow the diaphragm to vibrate faithfully to sound waves. If a microscopic rotational stress due to the screw occurs, the diaphragm assembly work needs to be done again. The rate that the assembly should be carried out again is called a failure rate, and the shape of the conventional ribbon diaphragm has a drawback of increasing the failure rate at the time of assembling.

Next, the invention described in a patent document related to the present invention is described. The invention described in Patent Document 1 relates to a method of manufacturing a ribbon microphone, and in particular, relates to a method of manufacturing the ribbon microphone capable of adjusting the tension of the ribbon diaphragm while observing the same. In the ribbon diaphragm described in Patent Document 1, both longitudinal ends are flat planes, and corrugated irregularities are formed continuously in an intermediate portion in the longitudinal direction. The both ends of the ribbon diaphragm are flat planes, and the both flat ends are crimped between presser plates and support plates by fastening screws, respectively.

[Patent Document 1] Japanese Unexamined Patent Application Publication No. 2006-319595

SUMMARY OF THE INVENTION

Problems to be Solved by the Invention

As the ribbon diaphragm of the conventional ribbon microphone, there is the one, wherein in order to provide an elastic strength, i.e., stiffness, an intermediate portion in the longitudinal direction except the both longitudinal ends is formed in such a corrugated shape that a line, which the top of a wave draws, is in the longitudinal direction of the diaphragm. According to the ribbon diaphragm having such a configuration, during assembly and also during the maintenance, such as the replacement of the ribbon diaphragm, it is possible to prevent the ribbon diaphragm from folding due to external factors, such as gravity and a wind force. This has an effect of facilitating the maintenance. However, in the conventional example shown in FIG. 5 to FIG. 10, and the invention described in Patent Document 1, the both ends of the ribbon diaphragm are flat and elastically weak, so the both ends of the ribbon diaphragm wobble during the assembly or maintenance and thus the operability is poor.

Moreover, in the ribbon diaphragm of the conventional ribbon microphone, since the both ends of the ribbon diaphragm, i.e., the electrode securing portions, are flat, a rotational stress caused by fastening the screw for securing the ribbon diaphragm causes a torsion in the ribbon diaphragm, which increases the failure rate in assembling the ribbon diaphragm.

In view of the prior arts described above, it is an object of the present invention to provide a ribbon microphone and a ribbon microphone unit, which can reduce a conductive resistance by forming a plurality of irregularities in the thickness direction in a portion for securing a ribbon diaphragm thereto, and thereby strengthening the contact between a secured portion of the ribbon diaphragm and a member for securing the ribbon diaphragm, and which further can facilitate the assembly of the ribbon diaphragm and the maintenance, such as the replacement, tension adjustment, or the like, by giving a rigidity to both ends of the ribbon diaphragm.

Means for Solving the Problems

According to a main feature of the present invention, a ribbon microphone unit comprises: a magnet for forming a magnetic gap; a ribbon diaphragm that is disposed inside the magnetic gap and vibrates in response to a sound wave, an electrode lead portion for outputting an electric signal that is generated by the ribbon diaphragm vibrating inside the magnetic gap; a frame provided with the magnet and the electrode lead portion; a tightening member which sandwiches both longitudinal ends of the ribbon diaphragm so as to be secured; and a screw for crimping the tightening member to the electrode lead portion of the frame, wherein the tightening member crimps the both longitudinal ends of the ribbon diaphragm by fastening a screw, the both longitudinal ends abutting against the electrode lead portion, and wherein the ribbon diaphragm includes a portion sandwiched by the tightening member, and the portion is formed in an irregular shape in the thickness direction.

Advantages of the Invention

By forming the irregularities in the thickness direction in the portion in contact with the tightening member on both ends of the ribbon diaphragm, microscopic contact is strengthened. This reduces the conductive resistance and thereby excellent acoustic characteristics can be obtained. Moreover, by giving a rigidity to the both ends of the ribbon diaphragm by forming the irregularities, the assembly of the ribbon diaphragm, and the maintenance, such as the replacement, tension adjustment, or the like, can be facilitated.

BRIEF DESCRIPTION OF THE DRAWINGS

FIG. 1 shows an example of a secured portion of a ribbon diaphragm used for a ribbon microphone according to the present invention, wherein FIG. 1A is an enlarged sectional view, FIG. 1B is an enlarged front view, and FIG. 1C is an enlarged side view.

FIG. 2 shows the ribbon diaphragm in the above-described embodiment, wherein

FIG. 3 shows an intermediate process of a maintenance related to the above-described embodiment, wherein

FIG. 4 shows a ribbon microphone unit according to the above-described embodiment, wherein

FIG. 6 shows an example of a conventional ribbon microphone unit, wherein

FIG. 7 shows a first example of a secured portion of a conventional ribbon diaphragm, wherein

FIG. 10 shows an example of the conventional ribbon diaphragm, wherein

DESCRIPTION OF THE PREFERRED EMBODIMENTS

Figure 4A:
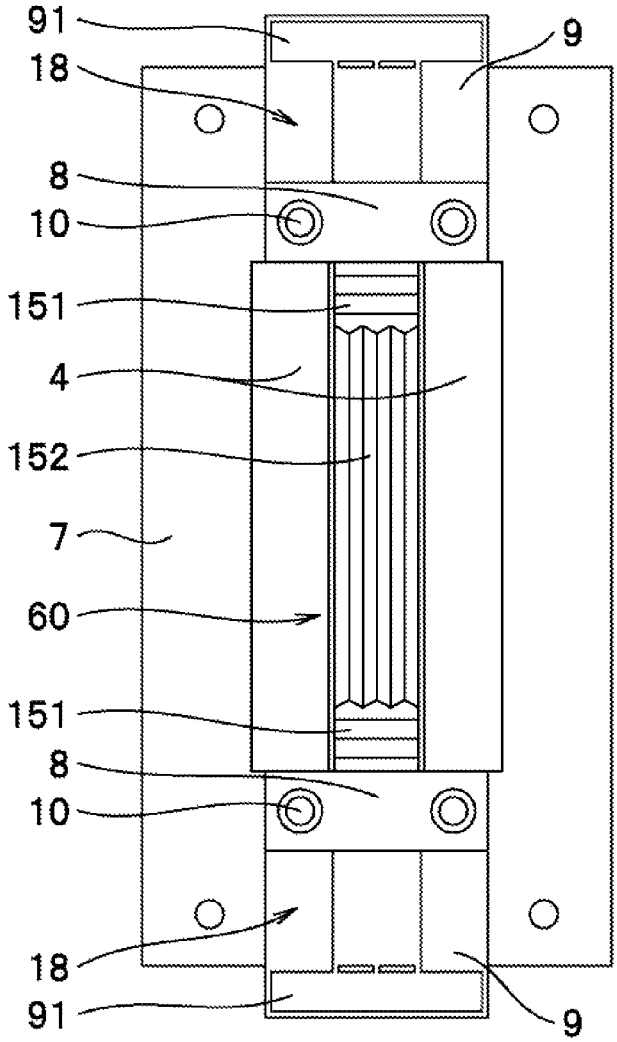
FIG. 4A is a front view.
Figure 4B:
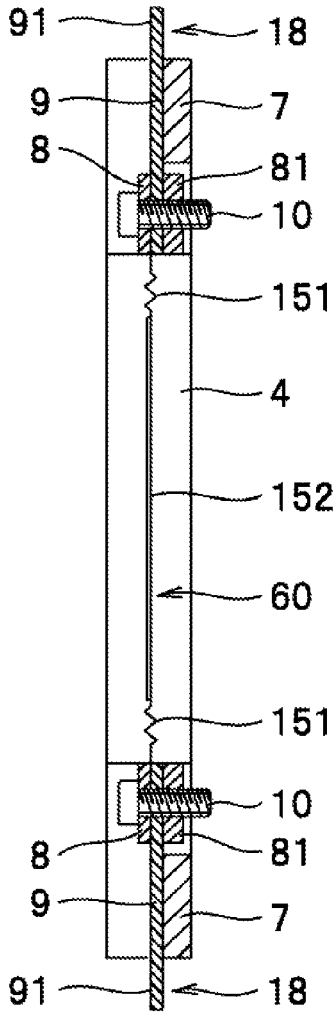
FIG. 4B is a side sectional view.
Figure 5:
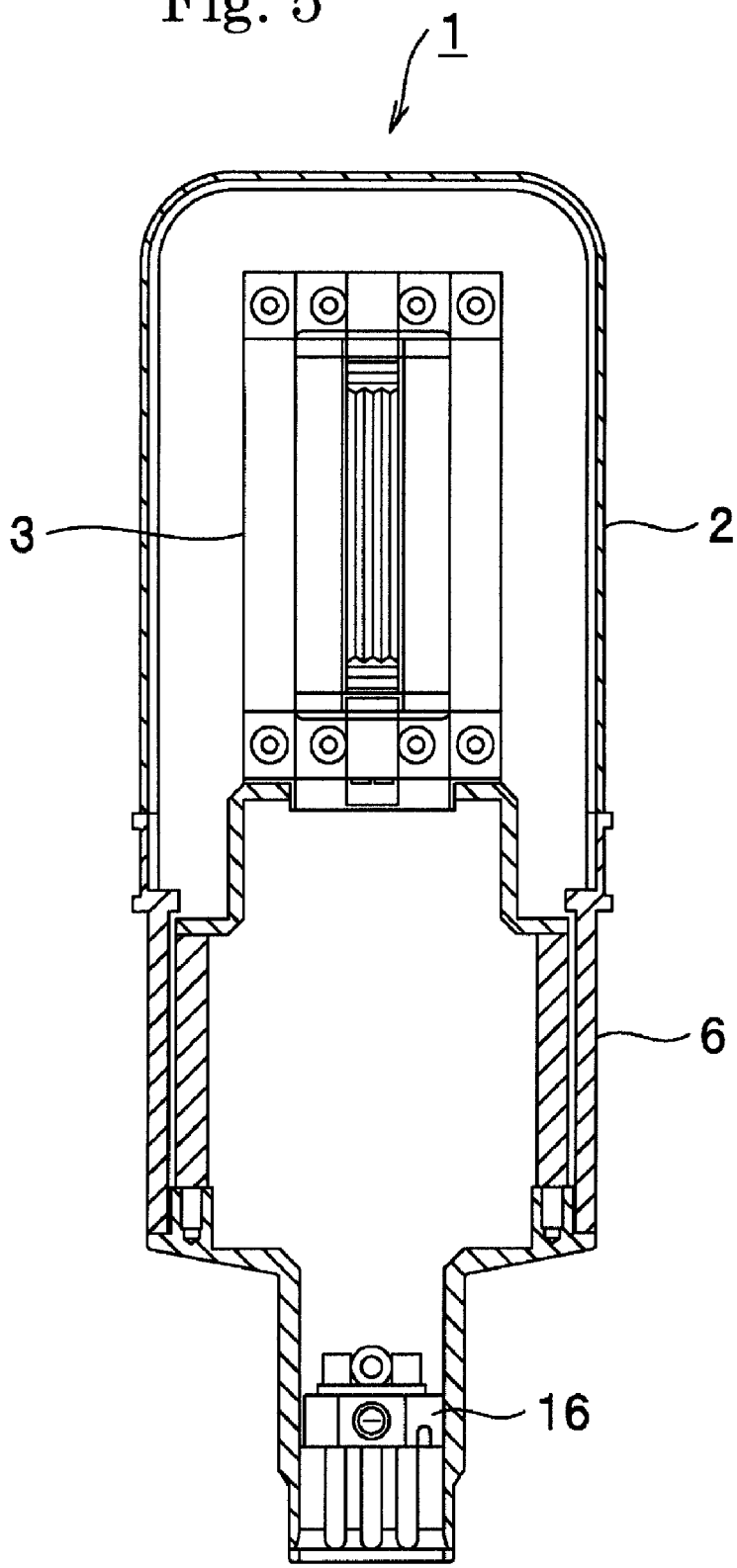
Related Art Fig. 5
FIG. 5 is a partial front sectional view showing an example of a conventional ribbon microphone.
Figure 6A:
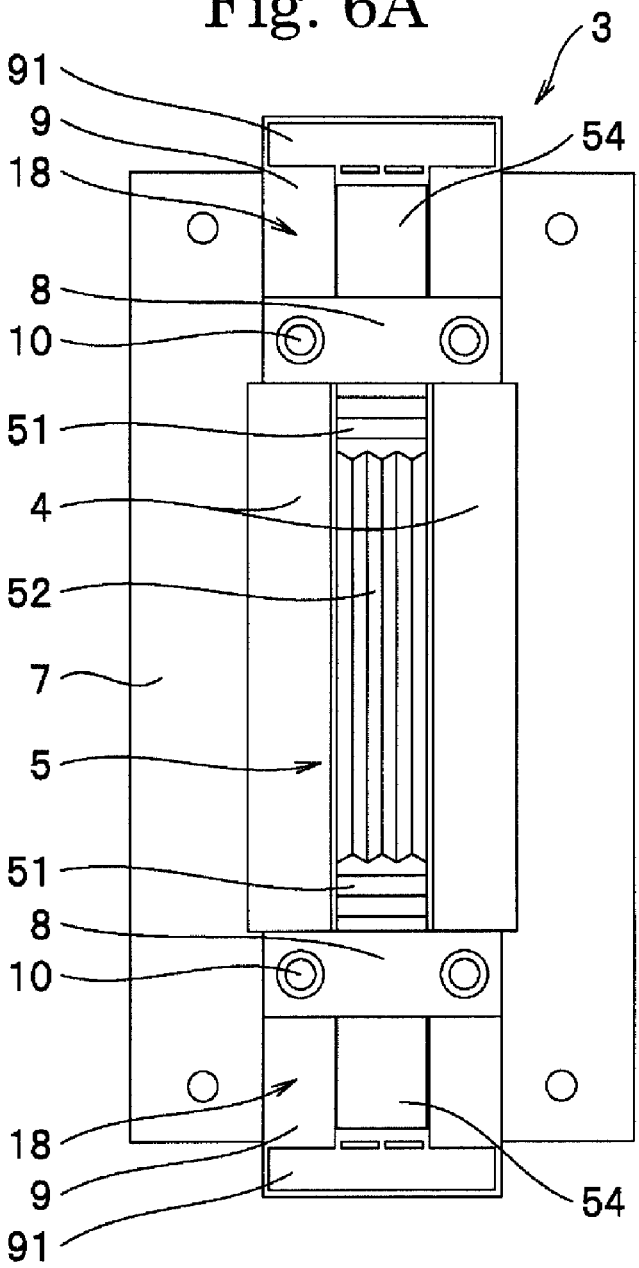
Related Art Fig. 6A
FIG. 6A is a front view.
Figure 6B:
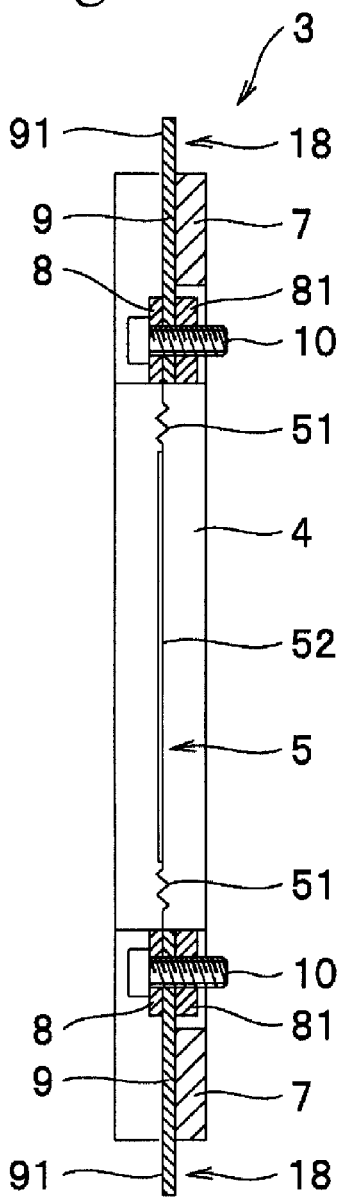
FIG. 6B is a side sectional view.
Figure 7A:
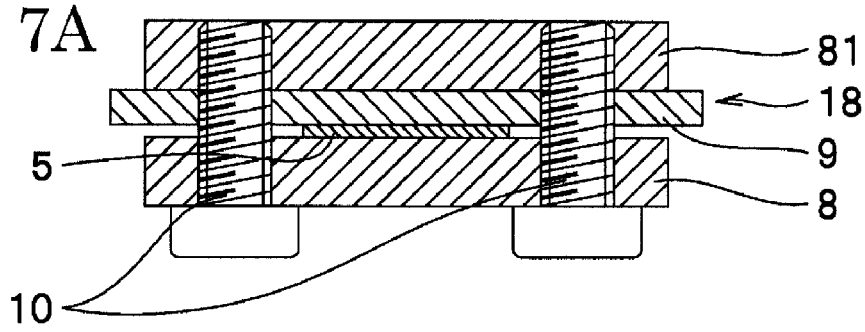
Related Art Fig. 7A
FIG. 7A is an enlarged sectional view.
Figure 7B:
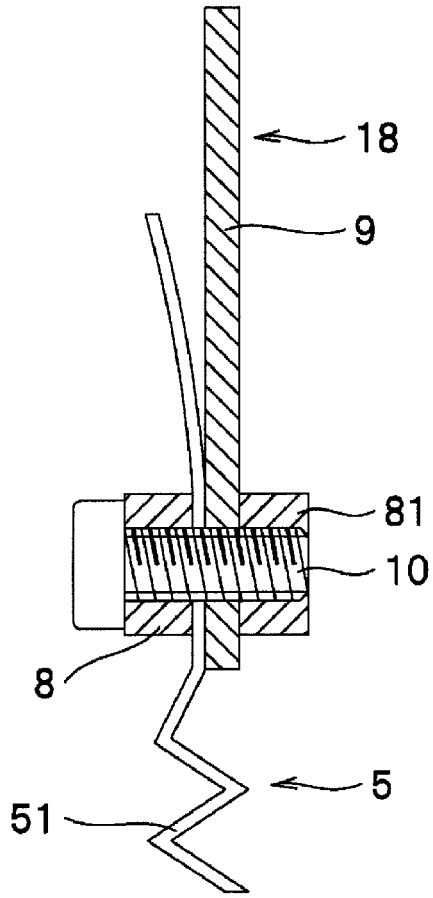
FIG. 7B is an enlarged side sectional view.
Figure 8:
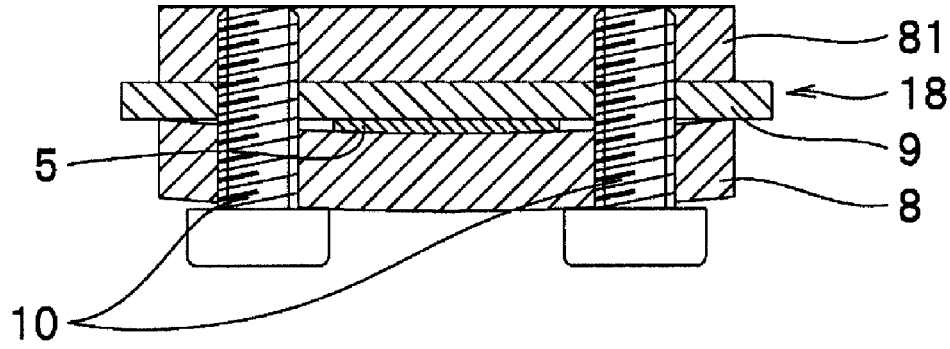
Related Art Fig. 8
FIG. 8 is an enlarged sectional view illustrating a state where a screw is fastened in the above-described conventional example.
Figure 9:
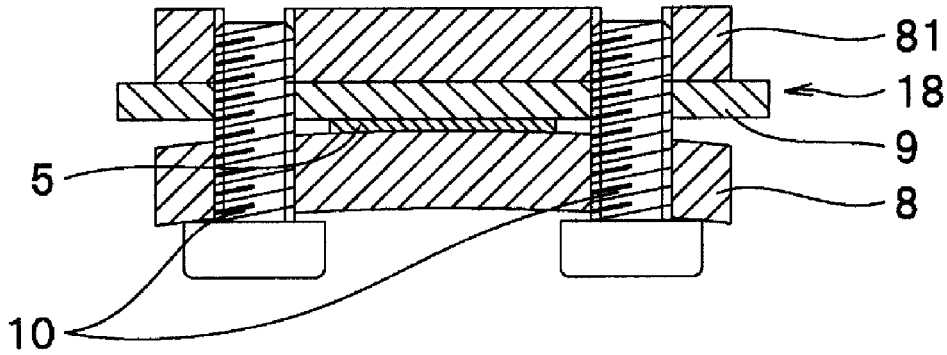
Related Art Fig. 9
FIG. 9 is an enlarged sectional view illustrating a second example of the secured portion of the conventional ribbon diaphragm.

An embodiment of a ribbon microphone unit according to the present invention will be described with reference to the accompanying drawings. FIGS. 4A and 4B show an embodiment of the ribbon microphone unit according to the present invention. The ribbon microphone unit shown in FIG. 4A comprises a frame 7, a magnet 4, an electrode lead portion 18, a terminal strip 9, a tightening member comprising a pressure plate 8 and a support plate 81, a screw 10, and a ribbon diaphragm 60. The frame 7 is formed in a rectangular frame shape that is long in the longitudinal direction, and a screw hole for securing to the microphone case 1 is formed at four corners. On the inner surface of the frame 7, a pair of permanent magnets 4, 4 is fixed on both sides along the longitudinal direction, with a predetermined spacing between the both permanent magnets 4, 4. The frame 7 is made of a magnetic material, functions as a yoke, and constitutes a magnetic circuit that goes out of the permanent magnets 4, 4 and returns to the permanent magnets 4, 4. The magnetization directions of the permanent magnets 4, 4 are the same. Accordingly, the parallel field is formed between the permanent magnets 4, 4. The ribbon diaphragm 60 is disposed within the parallel magnetic field.

Figure 2A:
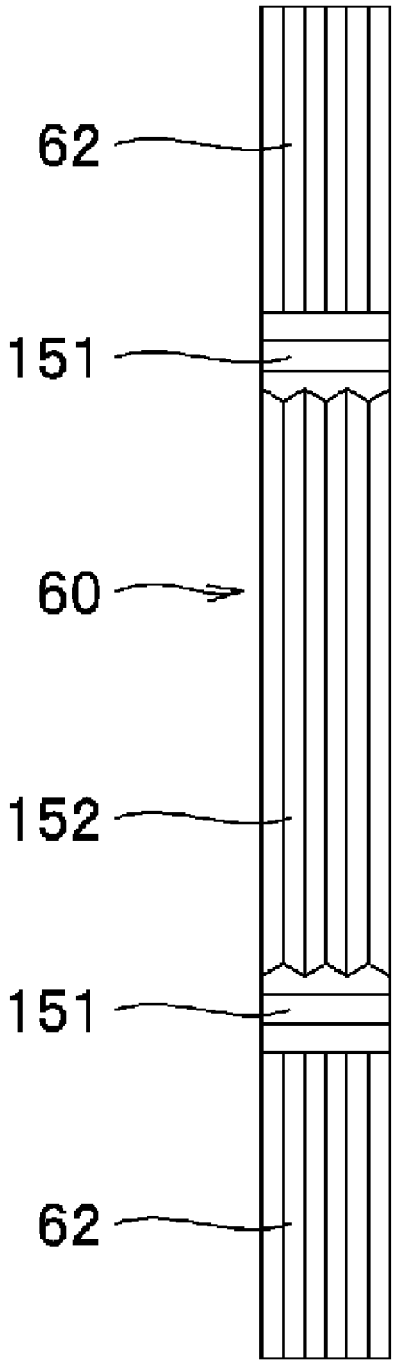
FIG. 2A is a front view.
Figure 2B:
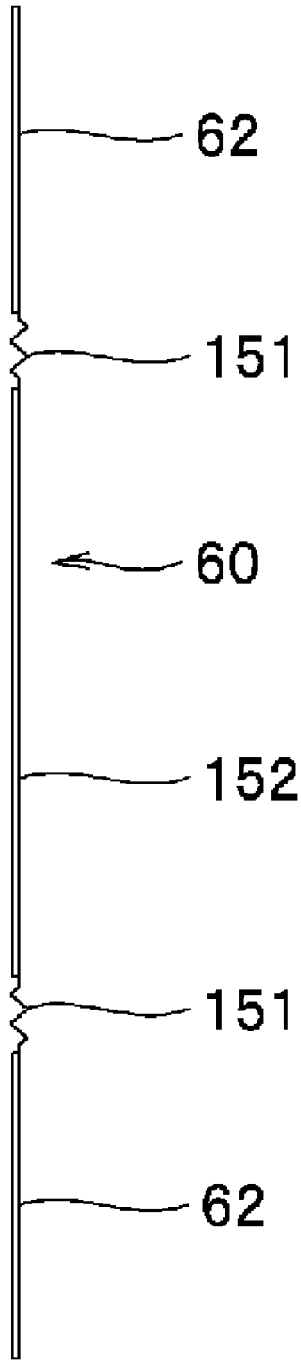
FIG. 2B is a side view.
Figure 10A:
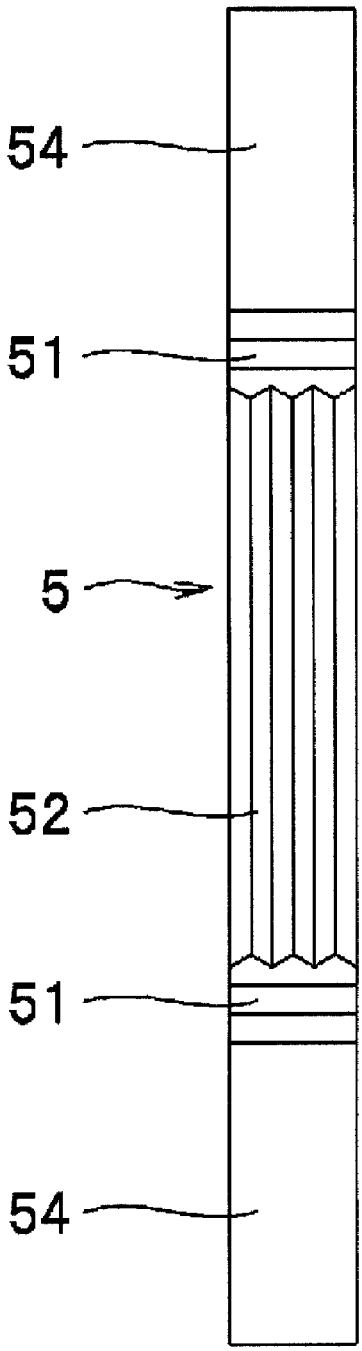
Related Art Fig. 10A
FIG. 10A is a front view.
Figure 10B:
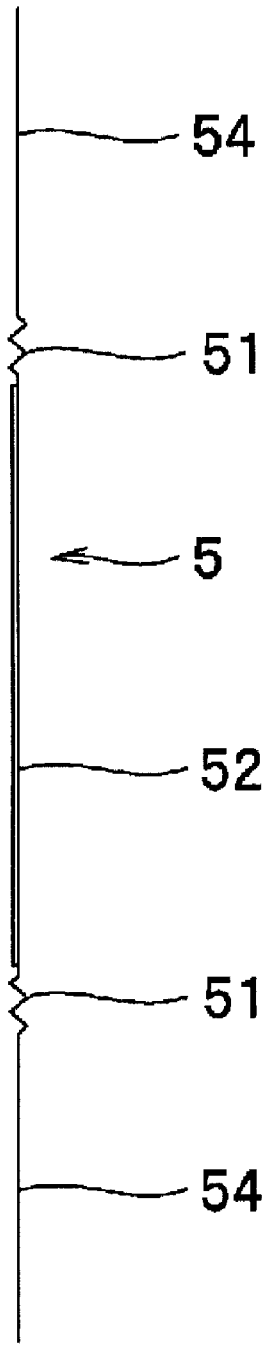
FIG. 10B is a side view.

The ribbon diaphragm 60 forms a long and slender band shape, as shown in FIGS. 2A and 2B, and comprises, in the longitudinal direction, a corrugated center portion 152 formed in the center portion, a corrugated connecting portion 151 continuously formed on both sides of the corrugated center portion 152, and both irregular-shaped ends 62 formed on the both longitudinal ends of the ribbon diaphragm 60 following the corrugated connecting sections 151. The corrugated center portion 152, the corrugated connecting portion 151, and the both irregularly-shaped ends 62 are formed in a different corrugated shape, respectively, as follows. The corrugated center portion 152 is formed in a corrugated shape in the longitudinal direction of the diaphragm 60 as the corrugated intermediate portion 52 in the conventional example shown in FIG. 10 is. The corrugated connecting portion 151 of the ribbon diaphragm 60 is formed in a corrugated shape in the width direction of the diaphragm 60 as the corrugated end 51 in the conventional example shown in FIG. 10 is. The both irregularly-shaped ends 62 of the ribbon diaphragm 60 are formed in an irregular shape in the thickness direction. The irregularities of the both ends 62 are triangular wave-like irregularities formed by being alternately folded at fixed intervals, and the direction of lines, which the top and the bottom of the triangular wave draw, is the longitudinal direction of the ribbon diaphragm 60.

The irregularities of the both ends 62 of the ribbon diaphragm 60 may be a plurality of stripe-like irregularities such as the illustrated example, or may be a plurality of broken-line-like irregularities. Due to the formation of the irregularities on the both ends 62, during the assembly of the ribbon diaphragm 60 or the maintenance, such as the replacement or tension adjustment, the elasticity and rigidity of the both ends 62 can be kept strong, and also the operability of the assembly or the maintenance can be improved. Moreover, by forming the both ends 62 of the ribbon diaphragm 60 in an irregular shape, the contact to the electrode lead portion 18, which will be described below, can be strengthened, and the electric resistance can be reduced. As long as the operability improvement in the assembly or maintenance and the reduction in the electric resistance as described above can be obtained, any irregular shape of the both ends 62 of the ribbon diaphragm 60 is employed.

Next, the configuration of the electrode lead portion 18 is described with reference to FIG. 1, FIG. 3 and FIG. 4. The both ends 62 of the ribbon diaphragm 60 are positioned in the electrode lead portion 18 of the frame 7. The electrode lead portion 18 integrally includes support plates 81, 81 near the both longitudinal ends of the frame 7, wherein each of presser plates 8, 8 is disposed on one side of these support plates 81, 81. The support plates 81, 81 and the presser plates 8, 8 have a rectangular shape that is long in the width direction of the frame 7, and each of the presser plates 8, 8 is adapted to be secured to the support plates 81, 81 by fastening the screw 10, respectively.

Between the support plates 81, 81 and the presser plates 8, 8, circuit boards 9, 9 and each of the ends 62, 62 of the ribbon diaphragm 60 are interposed, respectively. The both ends 62, 62 of the ribbon diaphragm 60 are sandwiched by the circuit boards 9, 9 and the presser plates 8, 8, respectively. If the screw 10 is loosened to loosen the compressive force caused by the presser plates 8, 8, the tension of the ribbon diaphragm 60 will be loosened. If one presser plate 8 is loosened and one side of the ribbon diaphragm 60 is pulled outwardly, a tension can be applied to the ribbon diaphragm 60. If the screw 10 is fastened in a state where an appropriate tension is given to the ribbon diaphragm 60, the presser plates 8, 8 can press the ends 62, 62 of the ribbon diaphragm 60 against the support plates 81, 81, respectively, to secure the ribbon diaphragm 60. The presser plates 8, 8 paired with each of the support plates 81, 81 constitute tightening members for securing the both longitudinal ends 62, 62 of the ribbon diaphragm 60.

A predetermined circuit pattern is formed in the circuit boards 9, 9, and the both ends 62, 62 of the ribbon diaphragm 60 are pressed against this circuit pattern, and the circuit pattern of the circuit boards 9, 9 and the ends 62, 62 of the ribbon diaphragm 60 are electrically conducted. A part of the circuit boards 9, 9 projects outwardly from the both longitudinal ends of the frame 7, and electrodes 91, 91 are formed in these projecting portions. The electrodes 91, 91 function as an output terminal for sound signals, respectively.

Figure 3A:
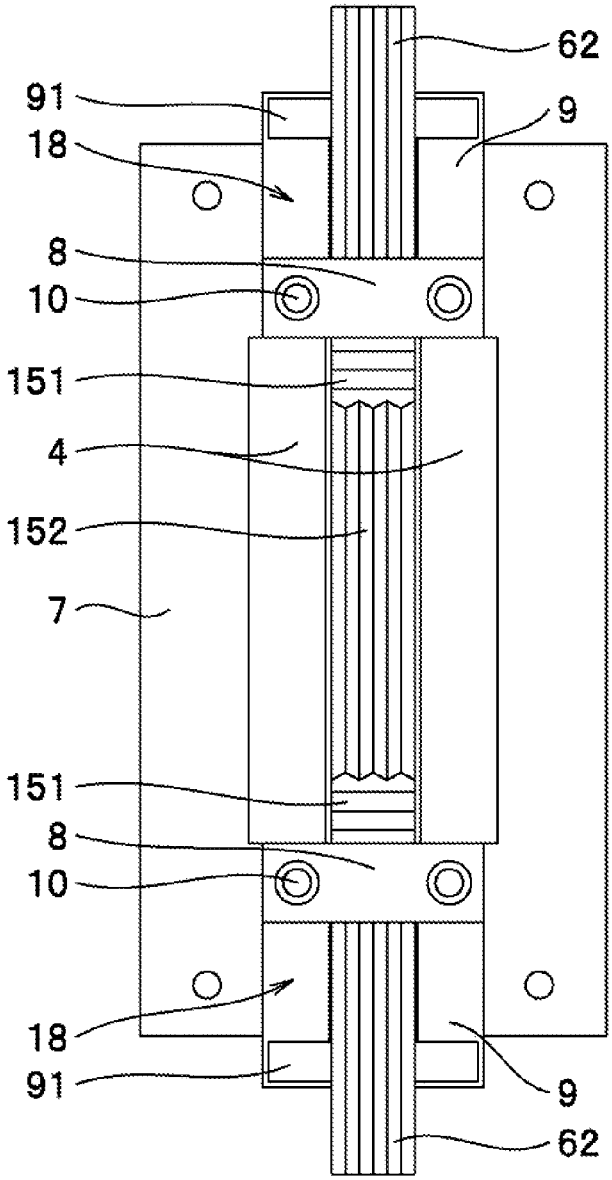
FIG. 3A is a front view.
Figure 3B:
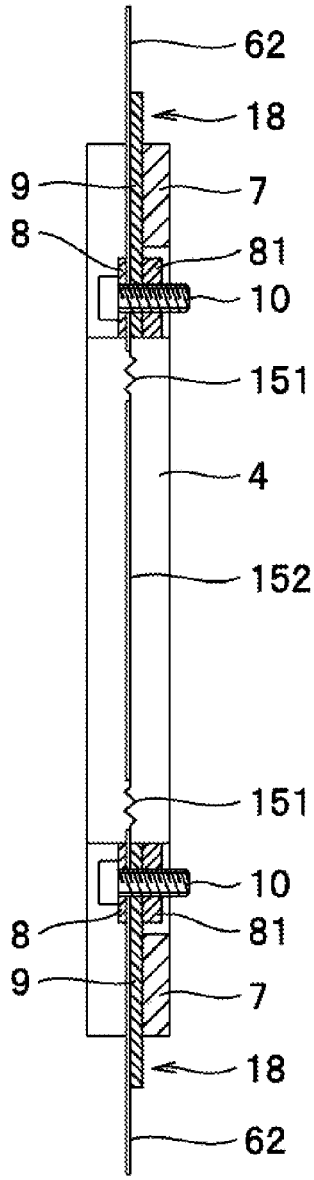
FIG. 3B is a side sectional view.

FIGS. 3A and 3B show one process of the ribbon microphone unit assembly. The both ends 62, 62 of the ribbon diaphragm 60 extend outwardly in the longitudinal direction of the frame 7. In order to assemble the ribbon diaphragm 60 into the frame 7, the both ends 62 of the ribbon diaphragm 60 are disposed in the electrode lead portion 18, and then each of the screws 10, 10 inserted in a hole of each of the presser plates 8, 8 is screwed into each of the support plates 81, 81, thereby securing the ribbon diaphragm 60. However, the tension of the ribbon diaphragm 60 is adjusted after the fastening force by the screw 10 is loosened, and then while being adjusted to an appropriate tension, the screw 10 is fastened to secure the both ends 62, 62 of the ribbon diaphragm 60. Next, a portion of each of the both ends 62, 62 of the ribbon diaphragm 60, the portion extending from the presser plate 8, is cut off. In the both ends 62, 62 of the ribbon diaphragm 60, as described above, at least a portion that is sandwiched by the support plates 81, 81 and the presser plates 8, 8, respectively, as the tightening members is formed in an irregular shape in the thickness direction.

According to the embodiment described above, as shown in FIG. 1C, the both ends 62, 62 of the ribbon diaphragm 60 are formed in an irregular shape in the thickness direction, and thereby these become highly rigid as well as highly elastic. This stabilizes the positions of the both ends 62, 62 of the ribbon diaphragm 60, and facilitates the work in securing the ribbon diaphragm 60 to the electrode lead portion 18 or the work in replacing the ribbon diaphragm 60 by the maintenance. Moreover, since both irregularly-shaped ends 62, 62 formed in the ribbon diaphragm 60 are highly elastic as described above, by fastening the screw 10 to the ribbon diaphragm 60 an effect of countering a rotational stress applied to the tightening member is obtained, and the torsion of the ribbon diaphragm 60 can be reduced.

Moreover, according to the above-described embodiment, as shown in FIG. 1A, the both ends 62, 62 of the ribbon diaphragm 60 are formed in an irregular shape, and thereby the contact to the electrode lead portion 18 is strengthened. Accordingly, the contact resistance between the ribbon diaphragm 60 and the electrode lead portion 18 can be reduced, and excellent output characteristics can be obtained without degrading the acoustic characteristics of the electric signal that is generated by the ribbon diaphragm 60 cooperating with the magnetic field.

By assembling the ribbon microphone unit according to the above-described embodiment into a microphone case, and then providing in a microphone case a connector for outputting an output signal from the microphone unit to an external circuit, the ribbon microphone unit can constitutes a ribbon microphone.

What is claimed is:

1. A ribbon microphone unit, comprising:

a magnet for forming a magnetic gap;

a ribbon diaphragm disposed inside the magnetic gap and is vibrated by a sound wave;

an electrode lead portion for outputting an electric signal generated by the ribbon diaphragm vibrating inside the magnetic gap;

a frame provided with the magnet and the electrode lead portion;

a tightening member which sandwiches both longitudinal ends of the ribbon diaphragm so as to be secured; and a screw for crimping the tightening member to the electrode lead portion of the frame, wherein the tightening member crimps the both longitudinal ends of the ribbon diaphragm by fastening a screw, the both longitudinal ends abutting against the electrode lead portion, and wherein the ribbon diaphragm comprises a portion sandwiched by the tightening member, and the portion is formed in an irregular shape in the thickness direction prior to the tightening member sandwiching the portion.

2. The ribbon microphone unit according to claim 1, wherein the irregularities in the both ends in the longitudinal direction of the ribbon diaphragm are a plurality of stripe-like irregularities.

3. The ribbon microphone unit according to claim 2, wherein a direction of a stripe in the stripe-like irregularities is parallel to a longitudinal direction in which the ribbon diaphragm is stretched along the frame.

4. The ribbon microphone unit according to claim 1, wherein the irregularities of the both ends in the longitudinal direction of the ribbon diaphragm are a plurality of broken-line-like irregularities.

5. The ribbon microphone unit according to claim 1, wherein the ribbon diaphragm has a corrugated-shape forming portion for making the diaphragm vibratable, in a longitudinally inner side than an irregularity-forming portion of the both longitudinal ends, and wherein a direction of lines, which a top and a bottom of a wave of this corrugated-shape forming portion draw, is a width direction of the diaphragm.

6. The ribbon microphone unit according to claim 1, wherein the tightening member comprises a support member and a pressure member secured to the support member by fastening the screw, and wherein the longitudinal end of the ribbon diaphragm is allocated between the support plate and the pressure plate.

7. A ribbon microphone, wherein the ribbon microphone unit according to any of claims 1 to 6 is incorporated into a microphone case.

8. The ribbon microphone unit according to claim 1, wherein the sandwiched portion is provided at an end of the ribbon diaphragm past a portion of the ribbon diaphragm that corresponds to the magnet.

9. The ribbon microphone unit according to claim 1, wherein the irregular shape in the thickness direction of the ribbon diaphragm extends beyond the sandwiched portion.

10. The ribbon microphone unit according to claim 1, wherein the ribbon diaphragm comprises a corrugated center portion of the ribbon diaphragm, a corrugated connecting portion continuously formed on both sides of the corrugated center portion, and irregular-shaped ends formed on both longitudinal ends of the ribbon diaphragm following the corrugated connecting portions.

11. The ribbon microphone unit according to claim 10, wherein the corrugated center portion, the corrugated connection portion, and the irregular-shaped ends are formed in different corrugated shape, respectively.

12. The ribbon microphone unit according to claim 11, wherein the corrugated center portion is formed in a corrugated shape in the longitudinal direction of the ribbon diaphragm, the corrugated connecting portion is formed in a corrugated shape in width direction of the ribbon diaphragm and the irregularly-shaped ends of the ribbon diaphragm are formed in an irregular shape in the thickness direction.

13. The ribbon microphone unit according to claim 12, wherein the irregular shape of the irregularly-shaped ends comprises triangular wave-like irregularities, formed by being alternately folded at fixed intervals, and wherein direction of lines in which top and bottom of the triangular wave draw, is a longitudinal direction of the ribbon diaphragm which is a direction in which the ribbon diaphragm stretches along length of the frame.

14. The ribbon microphone unit according to claim 10, wherein the irregularly-shaped ends are positioned in the lead portion which integrally comprises support plates near both longitudinal ends of the frame lead and wherein the irregularly-shaped ends extend outwardly and outside the frame in the longitudinal direction of the frame.

15. The ribbon microphone unit according to claim 10, wherein a portion of the irregularly-shaped ends is cut off after the ribbon diaphragm is sandwiched by the tightening member.

* * * * *